United States Patent [19]

Eltvik

[11] Patent Number: 5,014,538

[45] Date of Patent: May 14, 1991

[54] VEHICLE CHASSIS CLAMP

[75] Inventor: Bjorn Eltvik, Arboga, Sweden

[73] Assignee: Car-O-Liner Company, Wixom, Mich.

[21] Appl. No.: 91,746

[22] Filed: Sep. 1, 1987

[30] Foreign Application Priority Data

Sep. 3, 1986 [SE] Sweden ..... 8603696

[51] Int. Cl.[5] ..... B21D 1/12

[52] U.S. Cl. ..... 72/422; 72/705

[58] Field of Search ..... 72/422, 705; 248/671; 411/539

[56] References Cited

U.S. PATENT DOCUMENTS 2,810,536 10/1957 Cunningham ..... 248/671

3,625,047 12/1971 Lunardini ..... 72/705

3,818,579 6/1974 Pietrelli et al. ..... 72/705

4,274,323 6/1981 Resnicow ..... 411/539

4,505,145 3/1985 Bergstrom et al. ..... 72/705

*Primary Examiner*—Lowell A. Larson

*Attorney, Agent, or Firm*—Barnes, Kisselle, Raisch, Choate, Whittemore & Hulbert

[57] ABSTRACT

A vehicle chassis clamp for clamping a selected chassis part (7) which presents a throughpassing bolt joint (13*a–c*). The clamp comprises a U-shaped stirrup bracket (6*a*) having two legs so spaced as to straddle the chassis part (7). Each limb has a bush (14, 15) which can be tightened against a respective side surface of the chassis part, and each bush has a cavity (14*d*, 15*e*) which embraces a respective end of the bolt joint.

5 Claims, 2 Drawing Sheets

VEHICLE CHASSIS CLAMP

TECHNICAL FIELD

The present invention relates to a vehicle chassis clamp for clamping against a selected chassis part that exhibits a throughpassing bolt connection or joint.

BACKGROUND PRIOR ART

The work, for example, of determining the measurements of damaged vehicle chassis and of straightening (aligning) such chassis is normally carried out with the chassis secured to an alignment bench with the aid of chassis clamps attached, for instance, to the pinch weld connecting the doorsill assembly and the vehicle floor to the chassis. The pinch weld of vans and like light trucks or lorries is not strong enough for this purpose, and consequently it is necessary to support the chassis of such vehicles at other attachment locations, with the aid of separate clamps of particular construction. Hitherto, however, no such clamp has been proposed which is totally reliable in operation and which can be secured to the chassis with sufficient precision and with sufficient clamping effect.

SUMMARY OF THE INVENTION

Consequently it is the object of this invention to provide a vehicle chassis clamp which can be positioned accurately on and clamped securely to the vehicle chassis at locations other than the aforesaid pinch weld in a manner to hold the chassis with rigid firmness. Accordingly, the invention is based on the understanding that the chassis clamp shall be attached to parts of the chassis that are strong and robust and which present a throughpassing bolt connection or joint. One example of chassis parts which are both strong and present a bolt joint is the suspension (spring) attachments of the vehicle, these attachments normally being fitted to those parts of the chassis that are expected to take-up particularly large forces.

A clamp constructed in accordance with the invention and comprising a stirrup-like section having associated therewith apertured clamping means which each embrace a respective end of the bolt joint is extremely powerful and positionally stable. A certain amount of play can be tolerated therewith between the defining walls of the apertures of the clamping means and the components of the bolt joint.

BRIEF DESCRIPTION OF THE DRAWING

The invention will now be described in more detail with reference to the accompanying drawings, which illustrate a preferred embodiment of a chassis clamp according to the invention.

DESCRIPTION OF A PREFERRED EMBODIMENT

Figure 1:
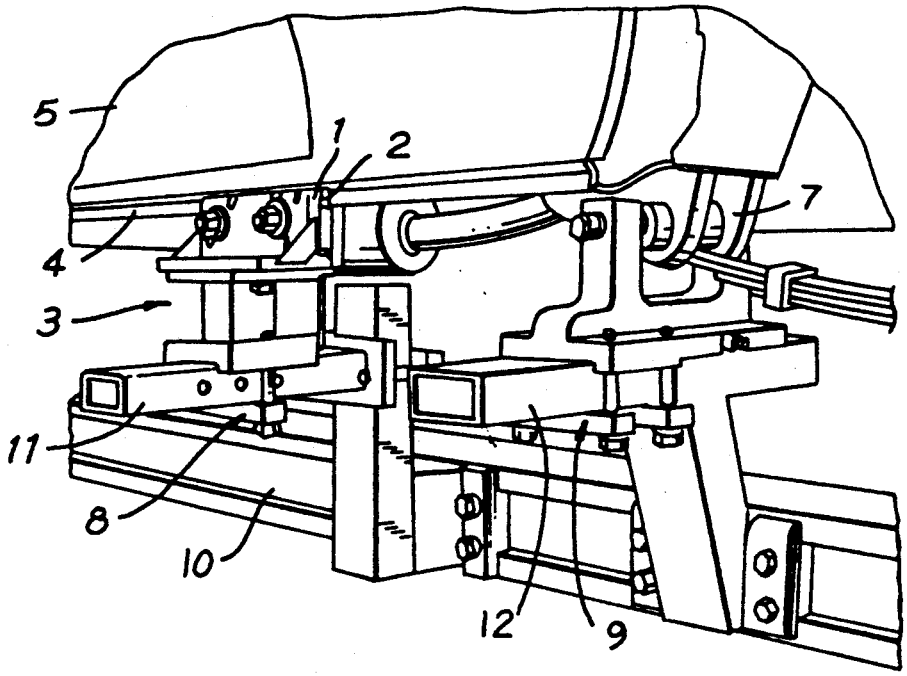
FIG. 1 illustrates in perspective a conventional vehicle chassis a vehicle chassis clamp according to the invention, with the clamps firmly clamped to a vehicle chassis.

In FIG. 1 there is shown a conventional clamp 3 which comprises two clamping jaw plates 1 and 2 and which is intended for clamping engagements with a pinch weld 4 on a vehicle chassis 5. Also shown in FIG. 1 is a chassis clamp 6 according to the invention clamped onto a spring attachment 7 on the chassis 5. Both clamps 3 and 6 have attachment means 8 and 9, for securing the clamp to a respective guide beam 11 and 12 mounted on an alignment bench 10.

Figure 3:
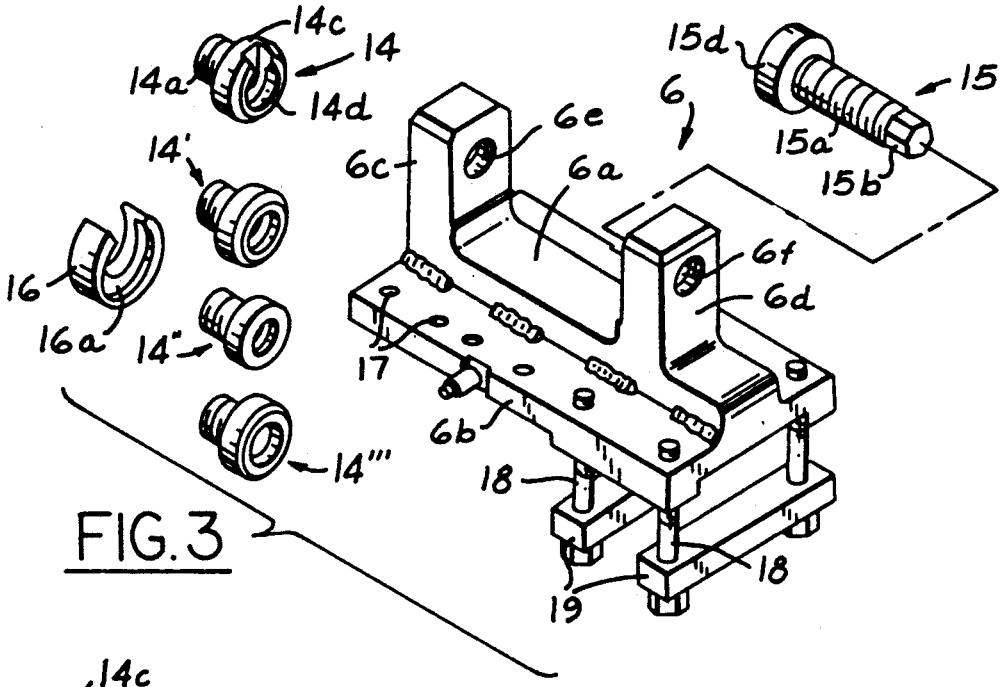
FIG. 3 is a perspective view of the components of the chassis clamp according to the invention, and is drawn to the same scale as FIG. 2.
Figure 4A:
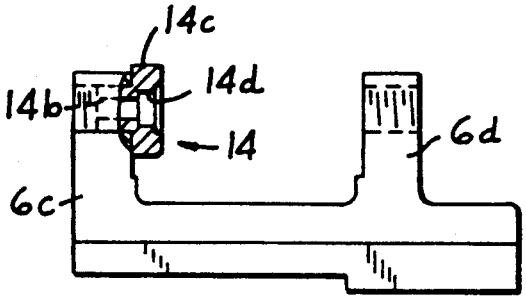
FIGS. 4*a–d* illustrate four different stages of fitting a chassis clamp according to the invention to part of a vehicle chassis.
Figure 4C:
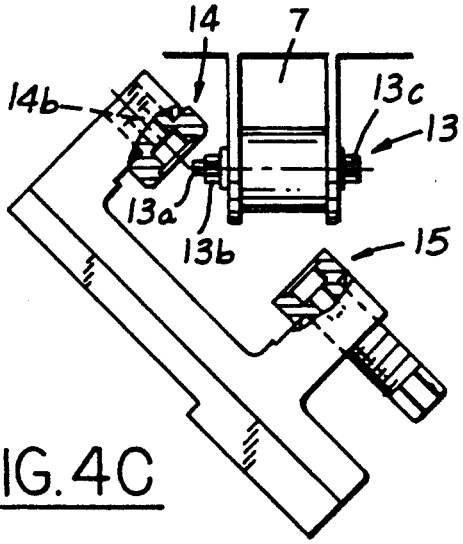

The chassis clamp 6 according to the illustrated embodiment of the invention includes a substantially U-shaped stirrup bracket 6*a* which is attached securely (e.g. welded) to a carrier plate 6*b* (or alternatively is made in one piece therewith). The two limbs 6*c* and 6*d* of the stirrup bracket are straight and parallel with one another, and each presents a respective screw threaded hole or bore 6*e* and 6*f* which face one another and are preferably mutually co-axial. The limbs 6*c* and 6*d* are intended to straddle the spring attachment 7, (see FIGS. 1, 2 and 4*c*) which has a throughpassing bolt connection or joint 13 (see FIG. 4*c*). To this end each of the limbs 6*c* and 6*d* is provided with respective clamping devices for clamping against respective outer surfaces of the attachment 7. In the illustrated embodiment these clamping devices have the form of two externally screw threaded sleeve bushes 14 and 15, each of which can be screwed into a respective hole 6*e* and 6*f*. The bush 14 comprises an externally screw threaded part 14*a* which can be screwed into the hole 6*e* and which has an axially throughpassing hole 14*b* (shown inter alia in FIGS. 4*a* and 4*c*), the dimensions of which are at least equal to the free end 13*a* of the bolt in the bolt joint 13 (see FIG. 4*a*), and further comprises a plain sleeve part 14*c* with a radial dimension which is larger than that of the hole 6*e*, whereby the sleeve part 14*c* of the bush forms a stop against the limb 6*c* when tightening the bush 14. The hole, or bore, 14*b* extends a short distance into the sleeve part 14*c*, to merge with an axial hole 14*d* (see FIG. 4*a*) which has the same radial dimension as the nut 13*b* of the bolt joint 13 (FIG. 4*c*). At those instances when less stringent requirements are placed on the accuracy to which measurements are taken, a certain amount of play can be tolerated between the walls of the hole, or bore, 14*b* and the nut 13*b*. In order to fit the bolt joints of different vehicle models, the hole 14*b* of the bush 14 may be given varying dimensions, as illustrated in FIG. 3 by the four examples 14, 14', 14'', and 14'''.

When fitting the clamp 6 in confined, awkward spaces, it is not always possible to tighten the bush 14 hard to the bottom, but must be left loosely screwed into its respective hole. Consequently, in order to enable the bush 14 to be positioned accurately in a given position, the clamp incorporates an insert element in the form of a split ring 16 (FIG. 3) which is placed over the bush 14, between the limb 6*c* and the sleeve part 14*c*, thereby enabling the bush 14 to be tightened until the sleeve part 14*c* bears against a bevelled surface 16*a* on the ring 16.

The bush 15 comprises an externally screw threaded bolt part 15*a* (FIG. 3) which can be screwed into the hole 6*f* and the threaded portion of which terminates short of the free end of the bolt part of said bush and adjoins in this region of the bush a section 15*b* of hexagonal cross-section, by means of which the bush 15 can be turned and therewith be moved axially towards the first mentioned bush 14.

Figure 4B:
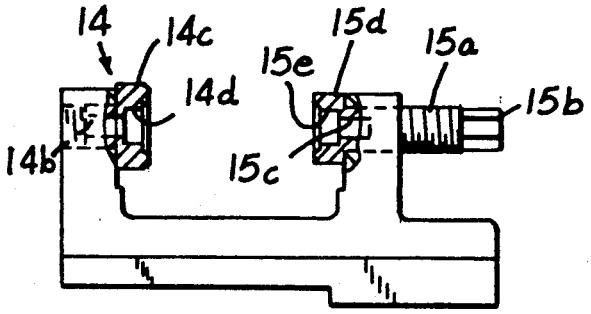
Figure 4D:
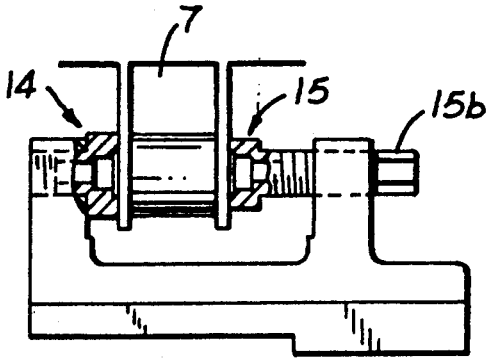

The other end of the bolt part 15*a* has provided therein a bore 15*c* (see for example FIG. 4*b*) such that the bolt part forms a sleeve bush in this region thereof, and merges with a plain sleeve part 15*d* of larger radial dimension than the hole 6*f*, whereby the sleeve part 15*d* forms a stop against the limb 6*d* when tightening the bush 15 thereagainst. The bore 15*c* extends slightly into the sleeve part 15*d* and there merges with an axial hole or bore 15*e* (e.g. FIG. 4*b*) having the same radial dimensions as the bolt head 13*c* of the bolt joint 13 (FIG. 4*c*). A certain amount of play can be tolerated between the defining surfaces of the hole 15*e* and the bolt head 13*c*, when requirements on measuring accuracy are less stringent. To enable the clamp to be used with different models of vehicle, the hole 15*e* of the bush 15 is given varying dimensions, analogous with that described with reference to the bush 14.

Figure 2:
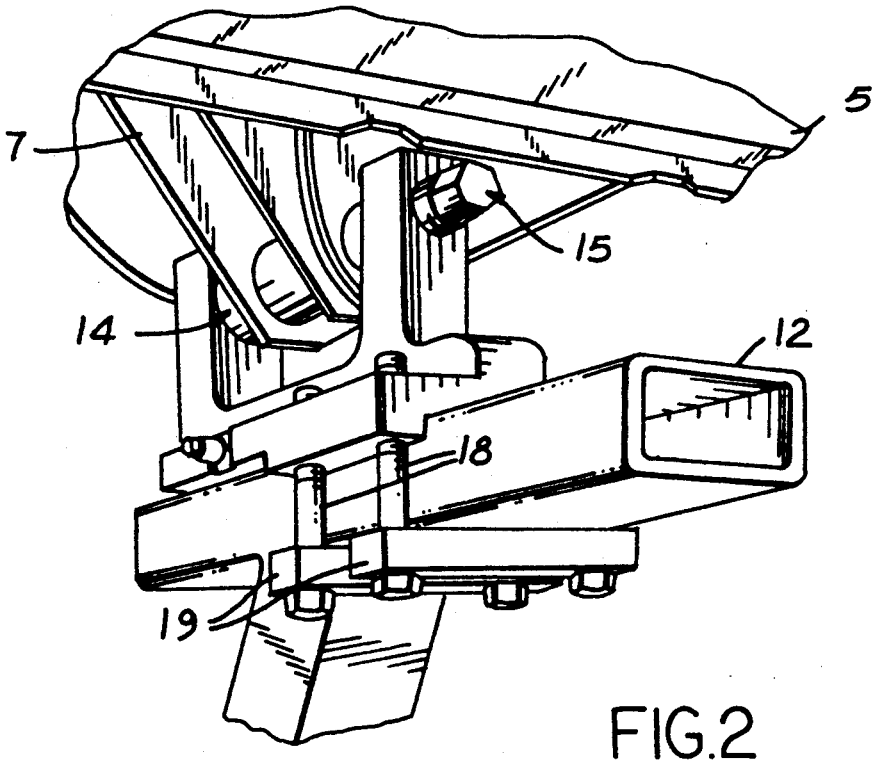
FIG. 2 is an enlarged view in perspective of the chassis clamp of the invention illustrated in FIG. 1, and shows this clamp from a different angle.

The carrier plate 6*b* of the clamp has provided therein a plurality of throughpassing, screwthreaded holes 17 which accommodate bolts 18 for screwing the clamp firmly to the beam 12 with the aid of clamping plates 19, as shown in FIG. 2.

FIG. 4*a*–4*d* illustrates the various stages of fitting the chassis clamp. Fitting of the clamp is preferably commenced by inserting a bush 14 into the hole 6*e*, FIG. 4*a*, and tightening the bush until it bottoms in the hole, provided that the insert 16 is not required for the reasons mentioned above. The bush 15 is then screwed into the hole 6*f*, FIG. 4*b*, and fully tightened to the bottom of the hole, so as to obtain the widest possible gap between the bushes 14 and 15. The clamp is then hung over the free end of the bolt joint 13*a*–*b*, FIG. 4*c*, and the clamp lifted until it registers with the head 13*c* of the bolt joint, see FIG. 4*d*. The bush 15 is then screwed in against the spring attachment 7, so as to tighten the clamp firmly thereto. The clamp can then be secured to the guide beam 12 by means of the bolts 18 and the clamp plates 19, as described in the aforegoing (see e.g. FIG. 2).

I claim:

1. A clamp assembly for securing a vehicle chassis having an attachment with a bolt joint for vehicle parts to an alignment bench having a pair of longitudinally extending and laterally spaced apart beams, said clamp assembly comprising a support receivable on, movable longitudinally of, carried by and releasably secured to only one longitudinally extending beam of an alignment bench, a guide fixed to said support and extending transversely to the longitudinal beam of the bench to which such support is secured, a carrier slidably received on said guide, clamp means releasably securing said carrier to said guide, a stirrup having a pair of limbs fixed to said carrier and spaced apart sufficiently to receive between them a bolt joint and an adjacent portion of an associated attachment, a pair of threaded holes one in each limb which are substantially coaxial, a first bush having a threaded shank received in the threaded hole in one of said limbs and a socket opening toward the other limb and having a recess constructed and arranged to receive a portion of a bolt joint projecting from the attachment and movable axially by rotation of its associated shank, a second bush having a threaded shank received in the hole of the other limb and a socket with a recess opening toward such one limb and constructed and arranged to receive a second portion of the bolt joint projecting from the attachment and movable axially by rotation of its associated threaded shank, said stirrup and bushes when said bolt joint portions are received therein supporting said bolt joint and attachment in spaced apart relationship from said carrier and said associated beam of said alignment bench, each said clamp assembly being adjustable both longitudinally and transversely independently of all other clamp assemblies on said alignment bench, whereby the clamp assembly can be releasably secured to the vehicle chassis by rotating at least one of such bushes to receive and entrap the projecting portions of a bolt joint in said sockets.

2. The clamp assembly of claim 1 in which the recesses of said sockets are dimensioned relative to such projecting portions of such joint so that when such projecting portions are received in said sockets, there is a negligible amount of play between each projecting portion and the socket in which it is received.

3. The clamp assembly of claim 1 which also comprises a split ring inserted between the socket of one of said bushes and the limb in which its associated shank is received.

4. The clamp assembly of claim 1 wherein the recess of the socket of one of said bushes also opens radially whereby a projecting portion of such joint can be inserted generally radially into such socket through such opening.

5. The clamp assembly of claim 1 which also comprises a retainer on said carrier for guiding its movement on said guide along a path transverse to the longitudinal beam of the bench to which said support is secured.

* * * * *